United States Patent [19]

Gehrt

[11] 4,414,443

[45] Nov. 8, 1983

[54] ENVIRONMENTALLY PROTECTED SWITCH CONSTRUCTION

[75] Inventor: Louis M. Gehrt, Jefferson County, Mo.

[73] Assignee: Emerson Electric Co., St. Louis, Mo.

[21] Appl. No.: 315,738

[22] Filed: Oct. 28, 1981

[51] Int. Cl.[3] ..... H01H 19/63

[52] U.S. Cl. ..... 200/80 R; 200/83 J; 200/302

[58] Field of Search ..... 29/622, 525; 200/80 R, 200/239, 302, 333, 337, 30 A, 83 R, 83 J, 30 R; 310/68 E, 68 B; 318/793

[56] References Cited

U.S. PATENT DOCUMENTS

| | | | |
|---|---|---|---|
| 3,185,788 | 5/1965 | Zollmann | 200/80 R |
| 4,002,868 | 1/1977 | Jooss et al. | 200/302 |
| 4,038,506 | 7/1977 | Filip | 200/83 J |

*Primary Examiner*—J. D. Miller
*Assistant Examiner*—D. L. Rebsch
*Attorney, Agent, or Firm*—Polster, Polster and Lucchesi

[57] ABSTRACT

A switch assembly for a dynamoelectric machine is provided with a protected switch contact for preventing foreign matter from affecting switch contact operation. Preferably, the assembly includes a support. A plurality of electrical connections are attached to the support. The switch assembly functions as an interface permitting connection of an external source of power to the dynamoelectric machine. The protected contact is a part of the start winding circuit and the protective device preferably includes a cap structure having a closed bottom and an open top. A second electrical contact is mounted to a switch arm through the cap structure and is movable in response to force applied to the switch arm. The open end of the cap structure is closed by a series of elements including a first washer. A soft compressible or pliable washer is positioned inboard of the first washer. A third metallic washer is positioned inboard of the pliable washer. A spring is positioned inboard of the third metallic washer, the spring being biased between the support surface and the third metallic washer so that the contact protecting elements remain in compliant abutment with the cap structure.

11 Claims, 7 Drawing Figures

ENVIRONMENTALLY PROTECTED SWITCH CONSTRUCTION

BACKGROUND OF THE INVENTION

This invention relates to switch assemblies for dynamoelectric machines and in particular to a switch assembly which is adapted to protect the start circuit electrical contact of that the dynamoelectric machine from malfunction because of the presence of foreign matter. While the invention is described with particular emphasis to its use in conjunction with switch contacts, those skilled in the art will recognize the greater adaptability and inventive concepts disclosed hereinafter.

There are certain applications for dynamoelectric machines that place those machines in environments having a high ratio of contaminants in the air to which the dynamoelectric machine is exposed. Two particular applications which easily come to mind are table saw or radial arm saw applications which employ motors to drive the saws, and swimming pool pumps and filter systems which employ motors as the drive source. Conventional wisdom dictates that these applications require the use of "totally enclosed motors." Those skilled in the art will recognize that the term "totally enclosed motor" refers to a motor construction in which the parts of the dynamoelectric machine, i.e., the stator, rotor and switch structure, along with the motor bearings, are protected from the environment in which they operate by specially designed closures or shells, end shields and bearings. Because the stator and rotor assembly of the motor are enclosed, these parts must be designed to operate at reduced temperatures. Generally, this requires longer motor core stack heights and additional winding material. While totally enclosed motors work well for their intended purposes, they are relatively high in cost, as compared to what is known in the art as open motors, especially if an open motor can be substituted directly in a closed motor application. Open motors, while having the same basic components as closed motors, i.e., a stator assembly, a rotor assembly, shell, end shield and bearings to support the shaft, use the environment of the dynamoelectric machine itself for cooling purposes, and consequently, the bearings, the core stack heights, and winding material employed in the stator and rotor assembly may be altered or reduced in one design as compared to the other. Obviously, this gives a lower cost motor for a particular application.

Because of their lower cost, open motors preferably are used where possible. In the past, open motors have been substituted for enclosed motors in table saws and the like. However, the substitution of an open motor in a table saw environment, i.e., where there is a high concentration of sawdust and microscopic particles in the air, has been plagued with motor failures. Motor failures occur because the electrical switch used in association with the open motor often fails. Commonly, the motors employed in these kinds of applications are either split phase or capacitor start, induction run motors. Those skilled in the art will recognize that such motors conventionally employ a centrifugal actuator to control the operation of the starting circuit of the motor. That is to say, at low speeds the actuator closes the switch so that an auxiliary or start winding is connected to a source of electrical energy, while the actuator disconnects the start winding as the motor reaches operating speed. It is the switch structure heretofore employed in making and breaking the electrical contact for the start winding that often malfunctions in the applications described above.

Motors used in conjunction with the pumps for swimming pool filter systems also have exhibited similar failure problems. Switch failure in this kind of application, while not attributable to sawdust in the air, is attributable to the fact that, for whatever reason, flying insects and other bugs seem attracted, or at least find their way into the dynamoelectric machine and often foul the operation of the switch assembly.

A number of attempts have been made in the prior art to alleviate switch failure problems. In particular, attempts have been made to enclose the starting switch contacts in order to protect them from their environment. While this has reduced the failure rate of open motors used in the above applications, it has not solved the problem to a suitable degree. I have found that open motors can be employed in many environmentally contaminated applications when the switch contact is protected by a structure which includes a very soft, pliable washer that has an interference fit in association with the switch terminal on which it is mounted. The entire structure that encloses the switch contact moves in response to forces applied to it by the centrifugal actuator, and the interference fit of the pliable washer effectively seals the electrical contact area. Moreover, the pliable washer must be "set" properly during construction of the dynamoelectric machine so that it is positioned correctly with respect to the switch post on which it is mounted. When this is accomplished, I have found that problems heretofore associated with use of open motors in contaminated environments are surprisingly substantially eliminated.

One of the objects of this invention is to provide an improved switch structure for dynamoelectric machines.

Another object of this invention is to provide a switch structure which prevents the fouling of the electrical contacts when the switch is exposed to an adverse environment.

Another object of this invention is to provide a switch structure for an open motor which includes means for preventing the fouling of at least one electrical contact of the switch.

Another object of this invention is to provide a low cost switch structure for a dynamoelectric machine.

Other objects of this invention will be apparent to those skilled in the art in light of the following description and accompanying drawings.

SUMMARY OF THE INVENTION

In accordance with this invention, generally stated, a switch assembly for a dynamoelectric machine includes structure for protecting at least one switch contact of the assembly from environmental contaminants. In the preferred embodiment, the switch assembly includes a support surface having the terminal to be protected extending outwardly from it. A switch arm is operatively associated with the support assembly and is adapted to be moved between at least first and second positions by a centrifugal actuator. The switch arm has a first electrical contact mounted to it and a cap positioned about the contact. A second electrical contact includes a cylindrical post mounted to the support assembly. The cap is closed bottomed and open topped, the top being closed by a washer plurality assembly which is mounted over the post contact. The washer assembly includes at least one pliable washer which has an interference fit with the post. The washer assembly closes the open top of the cap and prevents migration of any particulate matter into the area surrounding the contacts of the switch assembly. A spring is mounted between the support surface and the washer assembly to bias the plurality of washers in compliant contact with the cap structure and the switch contacts toward their opened position.

DESCRIPTION OF THE PREFERRED EMBODIMENT

Figure 1:
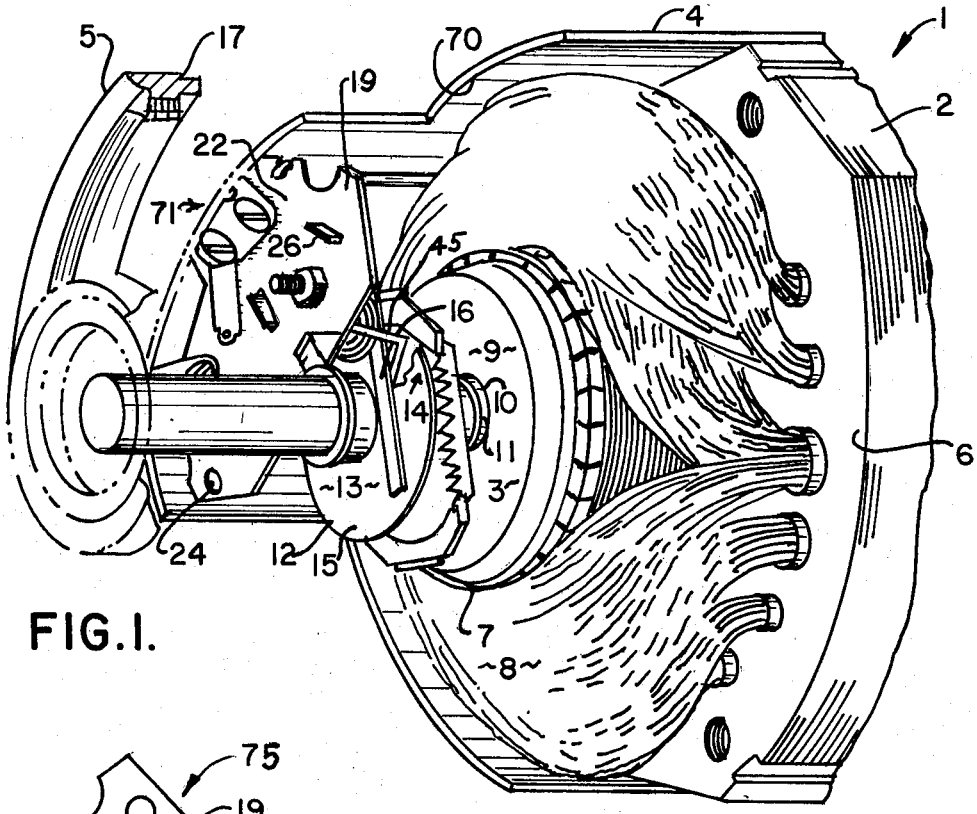
FIG. 1 is a view in perspective, partially broken away, of one illustrative embodiment of a dynamoelectric machine employing switch assembly of this invention.

Referring now to FIG. 1, reference numeral 1 generally refers to one illustrative embodiment of a motor with which the present invention finds application. The motor 1 includes a stator assembly 2 and a rotor assembly 3 which are housed in a shell 4. The shell 4 conventionally is closed, at each end, by a pair of end shields 5, only one of which is shown in the drawings.

The motor 1 is conventional and may comprise any of a variety of commercially available dynamoelectric machines. In general, the stator assembly 2 of the motor 1 includes a core assembly 6 constructed from a plurality of individual laminations formed from magnetic material. Each of the laminations has a central opening in it, and a plurality of slots extend radially outwardly from the central opening. When aligned, the central opening defines a bore 7 and the slots define a plurality of longitudinally extending winding receiving receptacles. A winding 8 is inserted in the receptacles of the core assembly. Winding 8 conventionally is constructed from magnet wire. Those skilled in the art will recognize that the term "magnet wire" refers to a suitable metallic wire having an electrically insulative film attached to it. The winding 8 may be, and preferably is, a distributed winding arranged in the various slots of the core assembly 6 according to a predetermining distribution pattern.

The rotor assembly 3 includes a rotor 9 having a central opening 10 extending through it, designed to permit the insertion of a shaft 11. The rotor 9 conventionally is a squirrel cage design constructed from a plurality of laminations aligned to form a core for the rotor, each lamination having a plurality of slots punched near the lamination periphery for receiving the rotor bar conductors. Normally, the conductor bars and end rings of the rotor assembly are die cast from aluminum, for example.

The shaft 11 is journalled for rotation along each of the end shield 5 by common bearing surfaces, not shown. The shaft 11 extends through at least one of the end shields 5 and functions to convert the motor 1 electrical energy input to a mechanical output. The shell 4 and end shields 5 delineate an enclosure for the motor 1, which enclosure in turn defines a chamber 70.

A centrifugal actuator 12 is mounted to the shaft 11, within the chamber 70. The actuator 12 rotates with the shaft 11. The actuator 12 includes a collar 13. Collar 13 is annular in plan, having a central opening for permitting the collar 13 to fit over the shaft 11 and to move axially with respect to the shaft 11 as centrifugal force draws a mechanism 14 radially outwardly during rotation of the rotor 9. The collar 13 has a face 15 which abuts a switch arm 16 in all non-rotating positions of the rotor 9. Construction of the centrifugal actuator 12 is well known. A description of such an actuator is shown and described in U.S. Pat. No. 3,271,602, the disclosure of which is incorporated herein by reference. Switch arm 16 is described in more detail hereinafter.

The shell 4 generally is a cylindrical section of sufficient length to house the stator and rotor assembly. The shell 4 may be crimped or otherwise fitted to the outer diameter of the stator assembly 2. The end shields 5 also may comprise a variety of designs. While an important consideration in motor manufacturing, the design of the end shields 5 generally is not a factor in this invention, and consequently, the end shields are not described in detail. It should be noted, however, that the invention disclosed herein is intended for use with end shields that are generally open, permitting free communication with the chamber 70. The end shields 5 also generally have a connection area 71 which gives access to a terminal board 19, when the terminal board is positioned inboard of the end shield. A conventional cover plate, not shown, may be utilized to close the area 71, if desired. It also is conventional to provide a lip 17 along the end shield 5 structure. Lip 17 functions to receive the respective ends of the shell 4. As indicated, when the shell 4 and the end shields 5 are mounted to one another, they define the chamber 70. It also is conventional to insert stator bolts through the end shields 5 and corresponding openings in the stator 2, the bolts extending from one side of the motor 1 to the other.

As discussed above, the openness of the motor 1 construction permits environmental contaminants to enter into the chamber 70. I have found that these contaminants can affect the operation of the motor 1, and particular, the operation of a switch assembly. The motor 1 may be and preferably is a split phase or a capacitor start motor, for example, in which a starting circuit for the motor 1, and in particular an auxiliary or start winding which together with a main or run winding delimit the winding 8, is electrically connected and disconnected to a source of electrical energy, not shown, dependent upon the position of the actuator 12 and speed of rotation of the rotor assembly 3.

Figure 2:
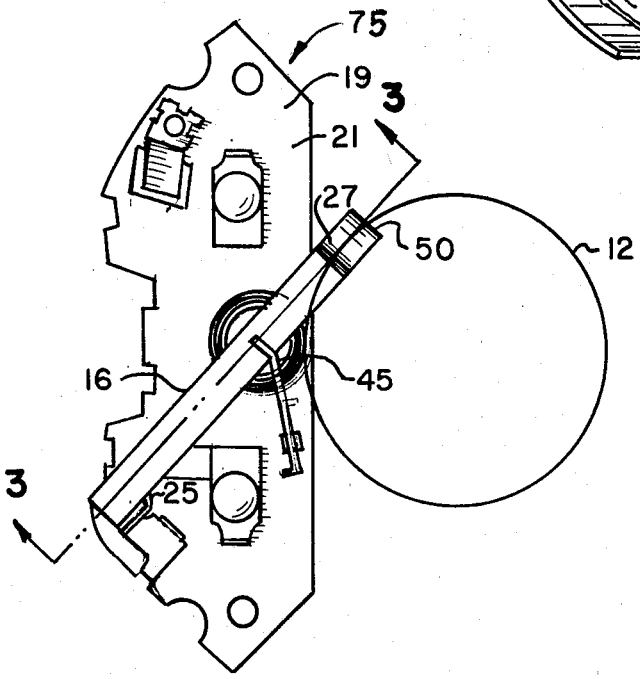
FIG. 2 is a top plan view of the switch assembly shown in FIG. 1.

As is best observed in FIG. 2, a switch assembly 75 includes a terminal board 19. Terminal board 19 generally is planar, with a first face 21 and a second face 22 having a material thickness 23 therebetween. The face 22 has a plurality of male quick connect terminals 26 extending outwardly from it, which are mounted to the board 19 by any suitable means. The terminal board 19 also has a pair of openings 24 which are used to mount the terminal board within the chamber 70 in any convenient method. Commonly, the terminal board is positioned on one of the end shields 5 or the stator shell 4 by screws not shown. Other mounting methods will occur to those skilled in the art.

Figure 3:
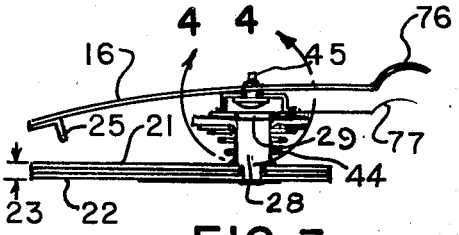
FIG. 3 is a sectional view taken along the line 3—3 of FIG. 2.
Figure 4:
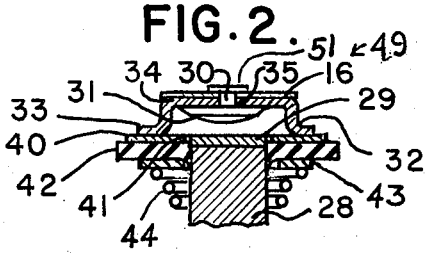
FIG. 4 is an enlarged view taken about the area 4—4 of FIG. 3, showing the proper set of the protective washer assembly.

A first end of the switch arm 16 is attached to a support structure 25 by any convenient method. Spot welding works well, for example. The arm 16 has a free second end 50 which is designed to provide a contact area 27 for abutment with the centrifugal actuator 12 in a conventional manner. Movement of the centrifugal actuator moves the switch arm 16 between a first position 76 and second position 77, which are best observed in FIG. 3.

The surface 21 has a post 28 mounted to it, the outward end of which defines an electrical contact 29. The contact 29 may be nothing more than the end of the post 28, or it may be specially constructed to increase its life operating cycle, if desired. The post 28 is attached to predetermined ones of the quick connects 26 so that the start winding of the motor 1 is energized when the switch arm 16 is in its second position 77, shown in FIG. 3.

The switch arm 16 has an electrical contact 31 attached to it. Preferably, the contact 31 has a centrally located neck 30 and integrally formed head 51. The head 51 is coined or otherwise formed to attach the contact 31 to the switch arm 16. The contact 31 is designed to make and break an electrical circuit with the contact 29, depending upon the position of the switch arm 16.

Mounted about the contact 31 is a cap 32. Cap 32 has an open top 33 and a closed bottom 34, the bottom 34 being closed except along an opening 35 which permits passage of the neck 30 prior to the attachment of the contact 31 to the switch arm 16 by coining head 51. Because of the construction employed, the switch arm 16, cap 32 and contact 31 move in response to forces applied to the contact area 27 of the arm 16.

The open top 33 of the cap 32 is closed by a first washer 40. The washer 40, in the embodiment shown, is annular in plan, and has a diameter greater than the diameter of the open top 33 of the cap 32. Washer 40 also has a central opening 41 through it, the opening 41 being sized so that the washer 40 fits freely over the post 28. Washer 40 preferably is made from an electrically insulating, arc track resistant material such as laminated glass melamine.

A second washer 42 is mounted inboard of the washer 40. Washer 42 also preferably is annular in plan, and has a central opening through it. Washer 42 preferably is manufactured of a "soft, pliable material". Self-extinguishing Neoprene-EPDM-SBR blend works well, for example. The central opening of the washer 42 is sized so that an interference fit is created between the washer 42 and the post 28. This interference fit is particularly important in the design of the switch assembly of this invention, as later described in greater detail.

Inboard of the washer 42 is a third washer 43 which also is annular in plan, a central opening in washer 43 being sized so that the washer 43 rides freely over the post 28. In the embodiment illustrated, the washer 40 is constructed from glass reinforced melamine, while the washer 43 is constructed from steel. The washers 40, 42 and 43 define a washer assembly 49.

A spring 44 is mounted between the washer 43 and the surface 21. The spring is sized and positioned so that it normally biases the washer assembly 49, and consequently the contact 31 toward an opened position. A stop 45 is mounted to the surface 21 and holds the switch arm 16 in a predetermined opened position against further movement by the spring 44. The distance between the contacts 29 and 31 may be adjusted by rotational movement of the stop 45. Since the switch arm 16 is cantilevered from its fixed end, rotation of the stop 45 toward the fixed end increases biasing force against stop 45, while rotation toward the free end of the switch arm 16 has the opposite effect.

Figure 5:
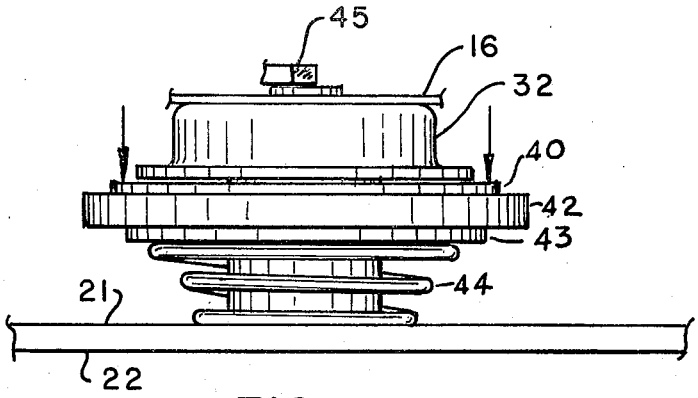
FIGS. 5, 6 and 7 are views showing a method for setting the protective washer assembly of the switch of this invention.
Figure 6:
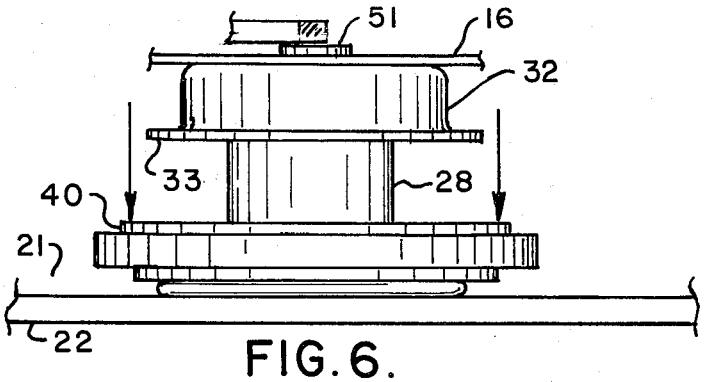
Figure 7:
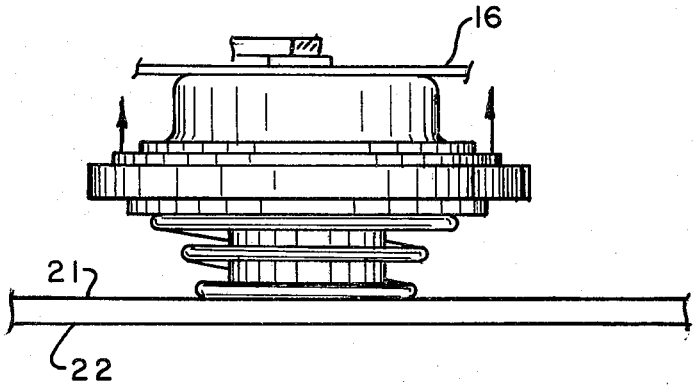

Setting of the environmental seal provided by the washer assembly 49 is accomplished relatively easily. Pressure is applied to the washer 40, as shown in FIG. 5. The washer assembly 49 is pushed downwardly against the bias of spring 44, as shown in FIG. 6, and thereafter the washer assembly 49 is released so that the assembly returns to the position shown in FIG. 7. This sets the washer 42 in proper relationship with the post 28 to prevent migration of dust or insects into the switch contact area along the post 28. The spring pressure abutment of the washer 40 with the cap 32, of course, also closes the switch contact area to contaminants along the cap 32/washer 40 boundary.

Numerous variations within the scope of the appended claims will be apparent to those skilled in the art in light of the foregoing description and accompanying drawings. For example, although particular materials were called out as preferred, other materials may be utilized. While only a single switch contact was provided with the sealing feature of this invention, other contacts may be so equipped. The design of the terminal board and related structure may be altered in other embodiments of this invention. These variations are merely illustrative.

Having thus described the invention, what is claimed and desired to be secured by Letters Patent is:

1. A switch assembly for a dynamoelectric machine, comprising:

a support surface having a first side, a second side, and a material thickness therebetween;

at least one electrical contact post having a predetermined diameter mounted to said support surface and extending outwardly therefrom on the first side thereof for operatively connecting said switch assembly to one of a source of electrical energy and said dynamoelectric machine;

an electrically conductive switch arm mounted along said support surface on the first side thereof, said switch arm having a free end movable in response to force applied to it between at least first and second positions, said switch arm being operatively connected to the other of said source of electrical energy and said dynamoelectric machine;

a stop mounted to said support surface and positioned to engage the switch arm, such engagement defining one of said first and second positions of said switch arms;

a second electrical contact mounted to said switch arm and aligned to provide electrical continuity with said at least one electrical contact in one of said first and said second positions of said switch arms;

a protective cap having an open top and a closed bottom, said closed bottom having at least a portion of said second electrical contact extending through it, said extension permitting attachment to said switch arm;

a first washer mounted on said first electrical contact post and being movable thereon, said first washer being sized to close the open top of said cap;

a second compressible washer and seal having an opening through it for receiving said electrical contact post, the diameter of said second washer being less than the diameter of said electrical contact post so as to create an interference fit therewith, said compressible washer being mounted inboard of said first washer and aligned therewith;

a third washer mounted on said first electrical contact post and being movable thereon, said third washer being mounted inboard of said second washer; and a spring mounted between said third washer and said second surface, said spring being biased to urge said switch arm toward engagement with said stop.

2. The switch contact of claim 1 wherein said second washer is constructed of a soft, pliable material.

3. The switch assembly of claim 2 wherein said third washer is steel.

4. The switch assembly of claim 3 wherein said spring has a conical shape, the base of said conical shape abutting said third washer.

5. The switch assembly of claim 4 wherein said cap is constructed from a brass material.

6. The switch assembly of claim 5 wherein said first washer is constructed from an electrically non-conductive material.

7. In a switch assembly including a support surface, an electrical contact having a predetermined diameter extending outwardly of said support surface, said electrical contact being operatively connected to one of a source of electrical energy and a device requiring electrical energy, and a switch arm mounted for movement between at least first and second positions, at least a portion of said switch arm being electrically conductive and being operatively connected to the other of said source of electrical energy and said device requiring electrical energy, the improvement comprising means for protecting the electrical contact against foreign matter, including a cap attached to and movable with said switch arm, said cap having a closed bottom and an open top, a first electrically non-conductive washer mounted on said first electrical contact and movable thereon, said first washer being sized to close the opened top of said cap; a second compressible washer seal having an opening through it for receiving said first electrical contact and movable thereon, the diameter of said second washer being less than the diameter of said first electrical contact, said second washer being mounted inboard of said first washer and being movable therewith; a third washer having an opening through it for receiving said first electrical contact, said third washer being mounted inboard of said second washer; and a spring mounted between said third washer and said first surface, said spring being biased to urge said protecting means and said spring arm toward one of the first and second positions of said spring arm.

8. The improvement of claim 7 wherein said second washer is constructed from a soft pliable material.

9. The improvement of claim 8 wherein said spring is conical.

10. The switch assembly of claim 7 further including a stop mounted to said support surface and positioned to engage said switch arm, such engagement defining one of said first and second positions of said switch arm, said stop being movable to adjust the distance of travel of said switch arm.

11. In a switch assembly for a dynamoelectric machine, said dynamoelectric machine having at least one winding operable by the action of a centrifugal actuator, said switch assembly being mechanically operated by said centrifugal actuator to energize and de-energize said winding, said switch assembly having at least one surface, a first switch contact mounted to said surface, and a switch arm mounted for movement with respect to said first switch contact, the improvement comprising a cap positioned about said first switch contact, said cap having a closed bottom and an opened top, said cap being movable with said switch arm; a first washer mounted inboard of said cap and sized to close said opened top, a second compressible washer seal mounted inboard of said first washer; a third non-compressible washer mounted inboard of said second washer; and a spring biased between said third washer and the surface of said switch assembly, said first, said second and said third washers being reciprocally movable on said first switch contact, in response to force applied to said switch arm and said spring, whereby movement of said switch arm makes and breaks electrical contact between said dynamoelectric machine and a source of electrical energy.

* * * * *